United States Patent [19]

Hori

[11] 4,455,936

[45] Jun. 26, 1984

[54] PRINTER SYSTEM WITH ALTERNATE TYPE BELT AND PRINT HAMMER POWER CONTROL

[75] Inventor: Fumihisa Hori, Tamayama, Japan

[73] Assignee: Alps Electric Co., Ltd., Tokyo, Japan

[21] Appl. No.: 431,301

[22] Filed: Sep. 30, 1982

[30] Foreign Application Priority Data

Dec. 28, 1981 [JP] Japan ..... 56-209833

[51] Int. Cl.[3] ..... B41J 1/18; B41J 1/20

[52] U.S. Cl. ..... 101/93.14; 400/146; 400/553; 101/111

[58] Field of Search ..... 101/111, 93.14, 93.13, 101/146; 400/133, 553

[56] References Cited

U.S. PATENT DOCUMENTS

| | | | |
|---|---|---|---|
| 2,831,424 | 4/1958 | MacDonald | 101/93.14 |
| 3,115,092 | 12/1963 | Sasaki | 101/111 X |
| 3,719,139 | 3/1973 | Niccolai | 101/111 X |
| 3,793,946 | 2/1974 | Sheffield | 101/111 |
| 3,793,951 | 2/1974 | Denley | 101/111 |
| 3,828,669 | 8/1974 | Bonafino et al. | 101/111 |
| 3,899,968 | 8/1975 | McDevitt | 101/111 |
| 3,942,437 | 3/1976 | Hatsuse | 101/111 |
| 3,949,665 | 4/1976 | Perry | 101/111 |
| 4,173,183 | 11/1979 | Akazawa | 101/93.14 |

OTHER PUBLICATIONS

"Determining Carriage Position in a Belt Printer", IBM Tech. Discl. Bulletin, vol. 15, No. 3, Aug. 1972, p. 906.

"Magnetoresistive Position Sensing and Motion Control of Print Corners", IBM Tech. Discl. Bulletin, vol. 15, No. 10, Mar. 1973, pp. 3113–3114.

"Impact Printer with Carrier and Character-Selection Apparatus Driven Off Same Motor", IBM Tech. Discl. Bulletin, vol. 23, No. 2, Jul. 1980, pp. 437–438.

*Primary Examiner*—E. H. Eickholt

*Attorney, Agent, or Firm*—Guy W. Shoup; Gerard F. Dunne

[57] ABSTRACT

A compact-size and light-weight serial printer system for a desk-top calculator or a small electronic device. It uses an endless printing belt adapted to be circulated and carrying a number of printing fonts. A carriage on which the hammer mechanism provided is slidably mounted and a rack shaft are positioned within the inner side of the endless printing belt. A reference position detection means is provided to generate trigger signals, for detecting the reference position on the endless printing belt, for initiating printing operations, and for selecting a desired printing font in conjunction with processings by the control section to calculate a movement distance of the endless printing belt. A single driving source is provided to drive each mechanism of the printer system. On the endless printing belt, the fonts which have lower frequency of usage are included in a single section, and those fonts which have higher frequency of usage are included in several sections.

17 Claims, 38 Drawing Figures

Fig. 28
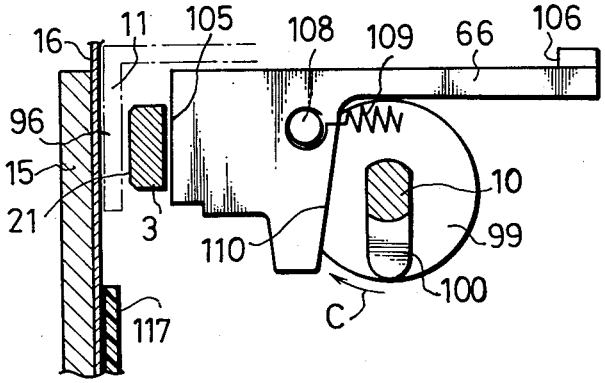
Fig. 29
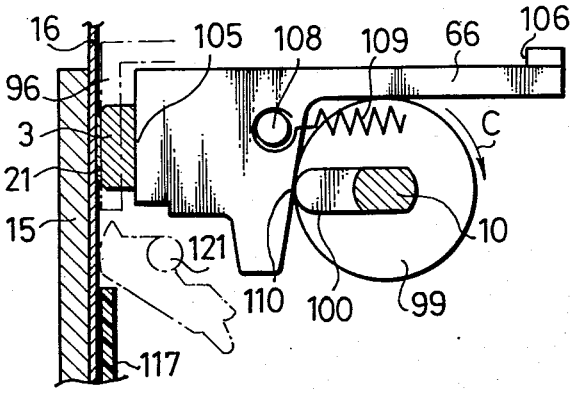
Fig.30(B)
Fig.30(A)
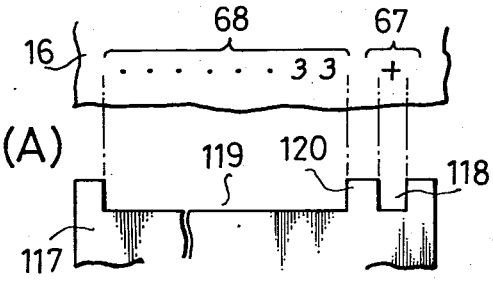

PRINTER SYSTEM WITH ALTERNATE TYPE BELT AND PRINT HAMMER POWER CONTROL

FIELD OF THE INVENTION

The present invention relates to a printer system and more particularly to a serial printer system which uses an endless printing belt for the printing mechanism.

BACKGROUND OF THE INVENTION

Recently, compact-size and light-weight desk-top calculators having multiple functions and higher performance have been developed, and it is desired that printers for these desk-top calculators be small in size and light in weight. Therefore, it is desired that those printers which are attached to or built into the modern desk-top calculators have lower consumption of power as well as be compact and light weight.

On the one hand, printers of the type which will be built in an electronic device for a home use should be able to use a commonly available and economical roll paper having a width of, for example, 38 mm or 58 mm, which is made of normal quality of paper. And, it is desired that those printers have a solid printing system using type fonts for fine finishing and legibility of printed data, and that they have a smaller number of driving sources of the printing mechanism to make the cost of the printer as low as possible.

BRIEF DESCRIPTION OF THE INVENTION

A compact-size and light-weight serial printer system for a desk-top calculator and other small electronic device comprises: an endless printing belt circulated in a certain direction and carrying a number of printing fonts. Driving means for circulating the endless printing belt are provided, as well as a paper feeding mechanism for feeding a printing paper positioned at the opposite side of the fonts arranged on the endless printing belt. A carriage on which a hammer mechanism is mounted is positioned at the inner side of the endless printing belt, facing the rear ends of the fonts, and engages a rotatable rack enabling carriage return and paper feeding. A single driving source is provided for driving the entire system of the printer mechanisms; and clutch means are provided for selectively driving the endless printing belt and the hammer mechanism.

Abovementioned serial printer system according to the present invention is provided with trigger signal generation means having a reference position detection section to sense a certain positon of the endless printing belt for activating printing operations based on generated trigger signals. The hammer mechanism mounted on the carriage which is moved laterally on the rack is provided with a isolation wall section having a font-projection opening for strictly positioning a selected font at a correct printing position. Lower order printing columns are assigned for printing of symbols, the remaining higher order printing columns are assigned for printing of numerals, and in between a no-printing zone is defined using a mask which is inserted between the endless printing belt and a printing paper.

Further, a serial printer system according to the present invention is provided with an endless printing belt on which a number of printing fonts are arranged, wherein the fonts are grouped into two groups; a first group includes fonts which have lower frequency of usage in printing, and a second group includes fonts which have higher frequency of usage in printing.

These and other objects, features, and advantages of the present invention will be more evident after the following more particular description of the invention.

BRIEF DESCRIPTION OF THE DRAWING

The attached drawings are for explaining embodiments of a printer system according to the present invention, wherein:

FIGS. 28 and 29 are side views of the printing section for explaning a printing operation;

FIG. 30A is a front view of a part of the paper guide wall;

FIG. 30B is a front view of a part of a printing paper which is printed by a printer system according to an embodiment of the present invention;

DETAILED DESCRIPTION OF THE INVENTION

General Structure

Figure 1:
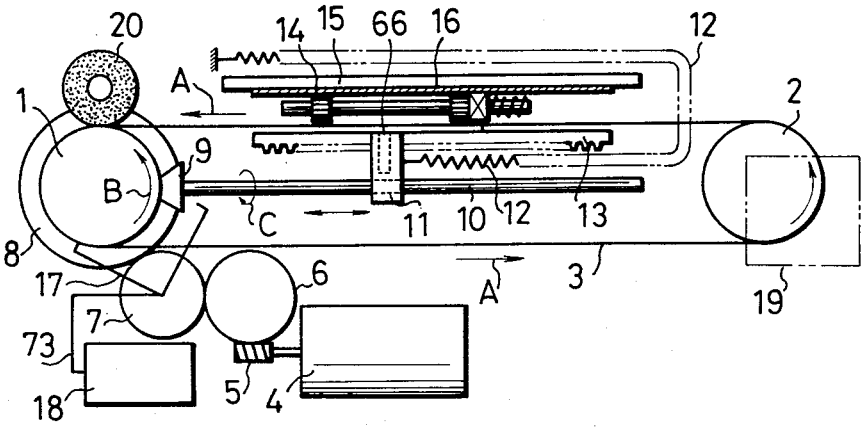
FIG. 1 is a plane view of a printer in a schematic drawing of configuration.

FIG. 1 is a schematic drawing showing a structure of a printer system according to the present invention. A driving pulley 1 and driven pulley 2 are positioned with a certain distance between them, and an endless printing belt is placed around the two pulley. A worm 5 is fastened to a rotor shaft of a DC motor which is the single driving source of the printer system, and the driving force of the motor 4 is transmitted to a main gear 8 by means of a first idle gear 6 and a second idle gear 7. The rotating force from the main gear 8 is transmitted to the driving pulley 1 by a spring clutch (described later), and the main gear 8 is engaged with a printing/column-shifting gear 9.

The printing/column-shifting gear 9 is linked with an end of a printing/column-shifting shaft 10 which is positioned between the driving pulley 1 and the driven pulley 2 and extended in parallel to the direction of the endless printing belt. The printing/column-shifting shaft 10 has a hammer holder 11 mounted on it which is laterally slidable in the direction of the axis of the shaft, and the hammer holder has a hammer, column-shifting-/paper-feeding cam, rack release lever, etc., on it as will be described later. The hammer holder 11 is linked with an end of a holder return spring 12, and the other end of the spring 12 is fastened to a base (described later). Therefore, the hammer holder 11 is normally pulled to the home-position side near the driven pulley 2 by a spring force of the holder return spring 12.

Near the printing/column-shifting shaft 10, a rack 13 is positioned in parallel with the shaft, and as will be described later, and the hammer holder 11 includes a column-shifting/paper-feeding cam positioned to interlock with the teeth of the rack 13. At the rear side of the rack 13, paper feeding rollers 14 and a flat guide plate 15 which serves as a platen are arranged, and a printing paper 16 which is fed under the guide plate 15 is positioned between the the paper feeding rollers 14 and the guide plate 15 and is guided to the opposite side of the printing fonts arranged on the outer surface of the abovementioned endless printing belt 3. Reference number 17 indicates a selection lever which can be switched to transmit the rotating force of the main gear 8 from the driving pulley 1 to the printing/column-shifting gear 9, and is operated by an electro-magnetic solenoid 18. Reference number 19 indicates the position detection section, which is provided near the driven gear 2, for detecting the reference position of the endless printing belt and a position of a selected font. And, reference number 20 indicates an ink roller which is in contact with the printing fonts arranged on the outer surface of the endless printing belt to supply ink onto type faces of the fonts.

A series of basic operations of a printer system according to the present invention consists of a font selection operation, printing/column-shifting operations, and hammer-holder return/paper-feeding operations, and printing of a multiple of lines are performed as those operations are sequencially repeated. Each of the abovementioned operations and the related mechanisms will be described later, but first a structure of the endless printing belt will be described below.

Structure of the Endless Printing Belt

Figure 3:
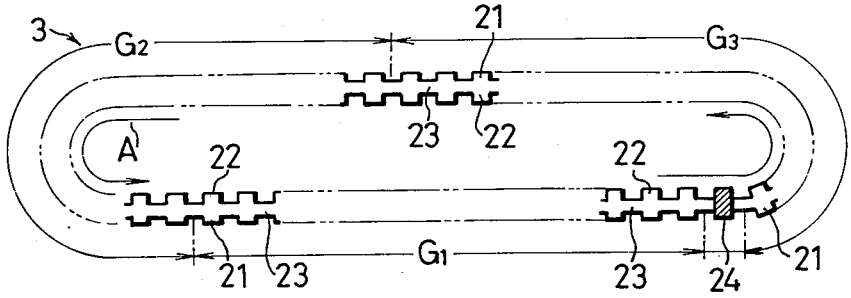
FIG. 3 is a plane view of an endless printing belt in a schematic drawing.

The printing belt 3 is structured in an endless circle. On the outer surface of the endless printing belt, a number of printing fonts 21 are arranged in a certain pitch along the circumference of the belt, as shown in FIG. 3, and a number of teeth 22 are arranged in a certain pitch on the inner surface of the endless printing belt. Each of the printing fonts 21 corresponds to a single tooth 22 to form a pair; i.e., the pitch of the arranged fonts is the same as that of the teeth section 22, and each font 21 (with a belt tooth 22) on the belt and an adjacent font 21 (with its belt tooth 22) are linked together by a thin linkage section 23. Those printing fonts 21, belt teeth section 22, and linkage section 23 are made of synthetic rubber or a plastic of low polymer, for example, and they are molded. Therefore, an entire body of the endless printing belt 3 has proper flexibility, expandability, and elasticity.

As shown in FIG. 3, the entire length of the endless printing belt is divided into three groups, for example; a first group G1, a second group G2, and a third group G3. The first group G1 includes each of the fonts of the symbols such as '+', '−', '×', '÷', a memory symbol 'M', total symbol 'T', sub-total symbol '<>', item count symbol '#', and other fonts which have lower frequency of usage, such as other alphabetic letters and special signs, compared with the fonts of digits which have higher frequency of usage. On the other hand, the second group G2 and third group G3 have the printing fonts which have higher frequency of usage such as the fonts of digits, and each group 62 and 63 has at least one of each of these types of fonts. The the fonts in the second group and the third group are in the same order. The details of arrangement of the printing fonts will be described later, but by making the arrangement of the printing fonts on the endless printing belt 3 as described above, the time for selection of a desired font can be made rather short.

Figure 4:
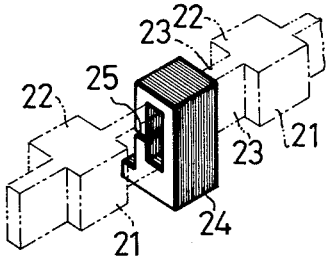
FIG. 4 is a perspective view which is magnified showing a part of the endless printing belt.
Figure 5:
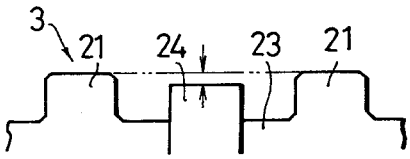
FIG. 5 is a magnified plane view showing a part of the endless printing belt.

At the boundary section between the first group G1 of fonts and the third group G3 of fonts, no font nor belt tooth is provided, and instead a pushing-down element 24 is provided. The pushing-down element 24 is a molding made of polyacetal resin, polyethylene resin, or polyamide resin, for example, which is plastic having relatively hard and sleek property, and has a 'C-shaped' form viewed from the side as shown in FIG. 4. The pushing-down element 24 is formed with a cut portion 25 to set it on the endless printing belt 3 at the linkage portion 23. The lower end of the pushing-down element 24 extends downwardly a distance greater than the bottom level of the printing fonts 21 and the belt teeth section 22 so as to lie on a lower plane in order to perform the function of pushing down which will be described later. On one hand, the pushing-down element 24 is positioned on the endless printing belt, as shown in FIG. 5, in a way that its face against the printing paper is placed back from a surface plane of the printing fonts, i.e., the front faces of the type fonts, so that the pushing-down element 24 will not contact the printing paper 16 when the hammer 66 is struck at the rear end of a selected font as will be described later.

Figure 6:
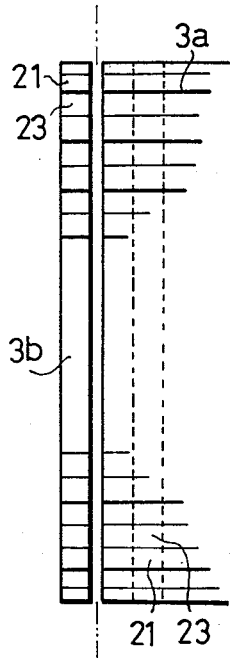
FIG. 6 is a plane diagram for explaining a fabrication method of the endless printing belt.

The endless printing belt 3 is fabricated as described below. That is, first a base material 3*a* for a printing belt is molded as a cylinder with a width longer but the same diameter as the endless printing belt, as shown in FIG. 6, and the base material 3*a* is sliced with a certain width (i.e., the height of the printing belt) to produce an endless strip 3*b* of a plastic as a base of the endless printing belt. Then, several of the sliced strips 3*b* with molded fonts on them can be produced from a cylinder-type base material, and each of the sliced strips 3*b* is attached with the abovementioned pushing-down element 24 at its predetermined position around the belt, which is set by opening the cut slot 25 of the element (see FIG. 4). Thus, the endless printing belt 3 is completed. As abovedescribed, on the outer surface of a sliced strip (belt) 3*a* as the base material, a number of printing fonts 21 were molded in a certain arrangement which is repeated a few times in the direction of the circumference of the belt, and the belt teeth section 22 was molded on the inner surface of the belt with a number of teeth consecutively arranged in the direction of the circumference.

As described in reference to FIG. 1, the endless printing belt 3 is placed around the driving pulley 1 and the driven pulley 2; the belt teeth section 22 provided on the inner surface of the endless printing belt 3 is interlocked with the teeth sections 26 of the driving pulley 1 and the driven pulley 2, respectively, (see FIG. 2); and thus, the endless printing belt 3 rotates properly around the two pulley without slippage. As shown in FIG. 1, the driving pulley 1 is rotated in the counterclockwise direction, and thus the endless printing belt 3 is moved in the arrow-indicated direction A. Therefore, the printing belt portion between the driving pulley 1 and the driven pulley 2, facing the printing paper 16, has a tension. Further, the pully shaft 27 of the driven pulley 2 is fastened with a code plate 28 (see FIG. 2) which will be described later, and the code plate 28 is contacted by contact blades 29 at its lower surface for the detection of font positions. Therefore, as the contact blades 29 are pressing the lower surface of the code plate 28, for example, the driven pulley 2 is normally applied with a braking force. Thus, the portion of the endless printing belt 3 which faces the printing paper 16 has no sag, and when the portion swings a little, it will not move to a large extent to the direction of the paper feeding. Therefore, the printing positions of letters and numerals printed are accurate, and though the distance between the endless printing belt 3 and the printing paper 16 is made smaller as the printer system is designed in compact size, the printing fonts 21 will not touch the printing paper 16 while the endless printing belt is moving. A description of the font selection mechanism will be given below.

Font Selection Mechanism

First, the driving mechanism of the endless printing belt 3 will be described in reference to FIG. 2. The base 30 which is molded using a hard plastic has a rectangular shape when viewed from the top, and at a frontside center position, there is provided motor installation section 31 wherein the abovementioned DC motor 4 is installed. At the left side of the motor installation convex section 31, a pin-shaped gear-holding shaft 32 and a cylinder-shaped gear holding cylinder 33 are projected upward from the base 30 with a certain distance between the two. The gear holding shaft 32 and the gear holding cylinder 33 are attached with a first idle gear 6 and a second idle gear 7 in a rotatable manner, respectively. The first idle gear 6 is provided with a helical gear section 34 which interlocks with the worm 5 that is fastened to the rotation shaft of the DC motor 4, and with a spur gear section 35 which interlocks with the second idle gear 7. On the other hand, the second idle gear 7 is formed with a spur gear section 36 which interlocks with the spur gear section 35 of the first idle gear 6. Therefore, by setting the first idle gear to the gear holding shaft 32 and the second idle gear 7 to the gear holding cylinder 33, the worm 5, first idle gear 6, and second idle gear 7 are interlocked each other.

Figure 7:
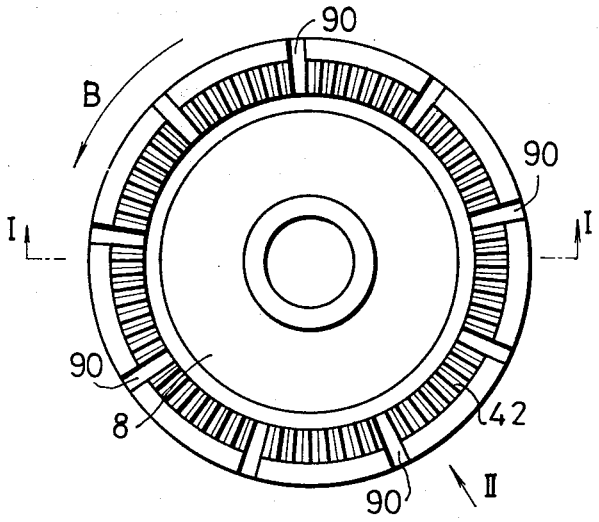
FIG. 7 is a plane view of the main gear.
Figure 8:
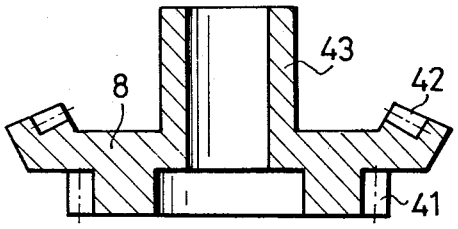
FIG. 8 is a cross-sectional view of the main gear looked at the line crossing the points I—I shown in FIG. 7.
Figure 9:
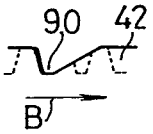
FIG. 9 is a view of the main gear from the arrow direction II shown in FIG. 7.

At the rear of the gear holding cylinder 33, there are standing a pin-shaped main gear holding shaft 38 and an ink-roller holding shaft 39; the main gear holding shaft 38 holds a main gear 8, spring clutch 40, and the driving pully 1 on it; and on the other hand, the ink-roller holding shaft 39 holds an ink roller 20 on it. The shape of the main gear 8 will be described in reference to FIGS. 7 to 9. FIG. 7 shows a plane view of the main gear 8. FIG. 8 shows a cross-section of the main gear 8 taken along the line connecting the points I—I shown in FIG. 7. And, FIG. 9 shows a view of the main gear 8 looked at the direction indicated by the arrow shown in FIG. 7. The main gear 8, as shown in FIG. 8, has a spur gear section 41 extending around its center axis, which interlocks with the spur gear section 36 of the abovementioned second idle gear 7, a modified frustroconical gear teeth section 42 which interlocks with the abovementioned printing/column-shifting gear 9 with a predetermined timing, and a center cylinder section 43. As this modified frustroconical gear teeth section 42 is used for the power transmission to the printing/column-shifting gear 9, its detailed shape and function will be described in the section "Printing/Column-shifting Mechanism" which is given later. As the main gear 8 is set to the main gear holding shaft 38, the main gear interlocks with the second idle gear 7, and the rotating force of the DC motor 4 is transmitted to the main gear 8 by means of the worm 5, first idle gear 6, and second idle gear 7, in such a way that the main gear 8 is rotated to a certain direction, i.e., the counterclockwise direction in FIG. 1, with a certain rotating speed.

In order to transmit the rotating force of the main gear to the driving pulley 1, or to interrupt the transmission, the spring clutch 40 is provided between the main gear 8 and the driving pulley 1. This spring clutch 40, as shown in FIG. 2, consists of a cylindrical driving arbor 44, a spring fixing tube 45, a font position selection ratchet 46, and a spring coil 47.

The lower end 47*a* of the spring coil 47 is inserted into a hole at the inner wall of the spring fixing tube 45 and fastened to it, and on the other hand, the upper end 47*b* of the spring coil is inserted into a hole on the inner wall of the driving pully 1 and fastened to it. The driving arbor 44 of which the outer circumference section is tightly wound by the spring coil 47 is inserted through the center holes of the spring fixing ring 45 and the ratchet 46, respectively, and set into a lower center hollow (not shown) of the driving pully 1. Thus, the center cylindrical section 43 of the main gear 8 is pressed in a manner such that it rotates in a close contact with the inner circumference section of the driving arbor 44 which is set as described above. A projection section 48 which is formed at the upper inner circumference section of the ratchet 46 interlocks with a radial cut section (not shown) provided in the lower center hollow section of the driving pulley 1 (but the radial cut section has a slightly larger size in length to the circumference direction compared with that of the projection section 48 of the abovementioned ratchet, so that the small gap between the two which is provided to the direction of the rotation corresponds to a loose angle of the spring coil 47); the upper tube section 49 of the spring fixing tube 45 is forcedly set into the inner wall of the center hole of the ratchet 46; and thus the spring fixing tube 45, the ratchet 46, and the pulley 1 rotate together. Therefore, the abovementioned three elements and the main gear 8 are linked in motion by means of the spring coil 47.

In a condition where a first dog 50 of the selection lever 17 which will be described later does not fall between teeth of the ratchet 46, the spring coil 47 compacts itself, and thus the main gear 8 and the driving pulley 1 rotate together. But, when the first dog 50 of the selection lever 17 and any tooth of the ratchet 46 interlock each other to stop the turning of the ratchet 46, the spring coil 47 expands and the rotating force of the main gear 8 is transmitted to the driving pulley 1.

Figure 10:
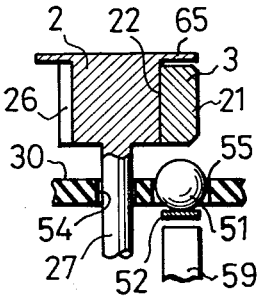
FIGS. 10 and 11 are magnified cross-sectional views of the reference position detection section.
Figure 11:
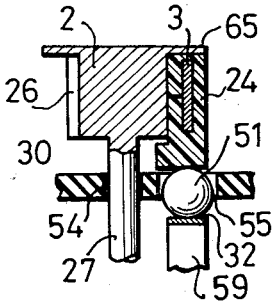

In order to select a printing font, it is not necessary to detect the reference position of the endless printing belt 3. Now, a mechanism for this reference-position detecting will be described below. As explained in reference to FIG. 1, the position detection section 19 is provided near the driven pulley 2. The position detection section 19 is mainly consisting of a ball-type button 51, a spring metal blade 52, a code plate (disk) 28, and contacts block 53, as shown in FIG. 2. The abovementioned ball-type button 51 is made of a metal or a hard plastic, and as shown in FIGS. 2, 10, and 11, it is inserted in a hole 55 for the ball provided at a position on the locus of the moving endless printing belt 3, near the shaft-standing hole 54 in which the pully shaft 27 of the driven pulley 2 is placed. As the tip of the spring metal blade 52 is placed under the hole 55 for the ball, the ball button 51 is held on the spring metal blade 52, and as shown in FIG. 10, the upper part of the ball button 51 is projected a little to a level higher than the upper surface level of the base 30 in a normal condition. The rear end of the spring metal blade 52 is bent in the upper direction to form a metal blade terminal section 56 which is projected through a terminal-arrangement slot 57 formed in the base 30, as shown in dotted lines in FIG. 2.

The center hole of the code plate (disk) 28 is tightly received by the the pulley shaft 27 of the driven pulley 2, and thus the code plate 28 rotates together with the driven pulley 2. On a lower surface of the code plate (disk) 28, an electric-conductive pattern is formed (not shown) which has a predetermined figure for detecting a rotation angle of the driven pulley 2, i.e., the rotational movement distance of the endless printing belt 3. The electric-conductive pattern is formed on the disk of an electric insulative material by the lithographic printing and etching technique, for example, or by sticking thin metal plates on the disk. The terminal arrangement block 53 consisting of a reset contact blade 58, a twin-split common contacts blade 59, a set contact blade 60, and a molding plate 61 in which the abovementioned contact blades are fixed by a molding method such as insert molding. Each of the contact blades 58, 59, and 60 is bent in the upper direction, for forming the reset terminal 62, common terminal 63, and set terminal 64, respectively, and they are arranged in sequence as shown by dotted lines in FIG. 2 in an alignment with the abovementioned metal blade terminal 56 in the terminal arrangement slot 57 to project their tips above the base surface. Each of the terminals 56, 62, 63, and 64 is connected by its respective lead wire (not shown) to a control section.

The tips of the reset contact blade 58, a shorter one of the common contact blade 59, and the reset contact blade 60 are spring-pressed on the lower surface of the code disk 28, and the longer one of the common contact blade 59 is placed under the spring metal blade 52 to face it with a certain gap between the two as shown in FIG. 10.

As the driving pulley 1 is rotated, the endless printing belt 3 rotates in the direction indicated by the arrow A (see FIGS. 1 and 3). When the pushing-down element 24 is not passing over the ball button 51, as shown in FIG. 10, the ball button 51 is projected a little bit above the surface level of the base 30 as it is being held by the spring metal blade 52, and the spring metal blade 52 and the common contact blade 59 are not in contact with each other. Then when the pushing-down element 24 is passing over the ball button 51 as the endless printing belt 3 is rotated, the top surface of the pushing-down element 24 touches the outer flange 65 of the driven pully 2; as a result, the pushing-down element 24 pushes the ball button 51" down against the spring force of the spring metal blade 52 as shown in FIG. 11; and thus, the spring metal blade 52 makes a contact with the common contact blade 59. By this contact, the metal blade terminal 56 and the common terminal 63 are momentarily connected in electric conductive condition, and a signal generated by the contact is available to detect the current position (i.e., the reference position) of the endless printing belt 3.

When the endless printing belt 3 is just passing over the reference position, distances from the reference position to the respective fonts arranged on the printing belt are known, or a distance to a certain font 21 which is opposite the hammer 66 is known. It is thus possible to know the time when a certain font which is selected by the control section is positioned opposite the hammer 66, by detecting a movement distance of the endless printing belt 3 after the detection of the reference position, i.e., by measuring a rotational angle of the driven pully 2 by counting electric signals using the position detection section 19.

Figure 12A:
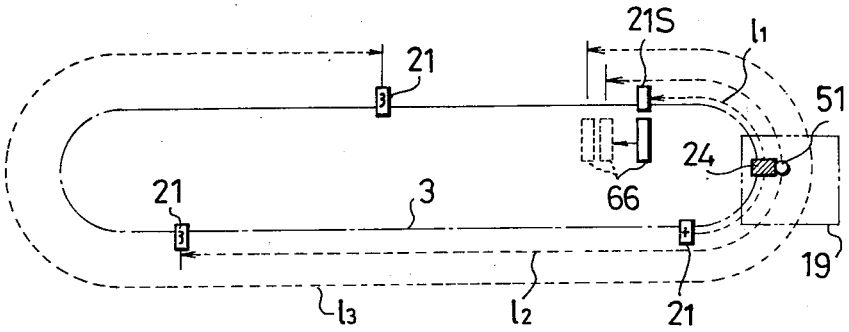
FIG. 12A is a drawing showing changes in motion of the endless printing belt in relation to column shifting.
Figure 12B:
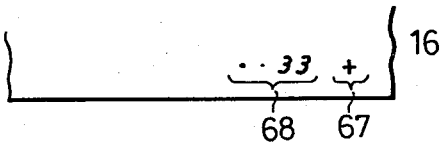
FIG. 12B is a front view of a part of a printing paper which is printed by an embodiment of a printer system according to the present invention.

Changes of movement distance of the endless printing belt 3 in relation to column shifting will be described in detail referring to FIGS. 12A and 12B. FIG. 12A is a drawing for showing changes of movement distance of the abovementioned endless printing belt 3. FIG. 12B is a partial front view of a printing paper 16 which is printed by an embodiment of the present invention.

First a case will be described where the hammer 66 is located at the lowest-order printing column as shown by the solid lines in FIG. 12A. The endless printing belt 3 is started to circulate in a certain direction initiated by a print state signal. It is assumed that the printing belt is turned to a position where the pushing-down element 24 which is placed at the boundary section between the third font group G3 and the first font group G1 pushes down the ball button 51 and thus the reference position is detected. At this moment, the movement distance $l_1$ of the belt between the font 21S which is just facing the hammer 66 and the font 21 for printing of the symbol '+' that is to be printed at the lowest print column is calculated by a processing in the control section; the movement of the endless printing belt 3 is measured to find out the moment when the belt ran the distance $l_1$ by counting electric signals generated by using the position detection section 19; and then the font 21 of the symbol '+' is struck against the printing paper by the hammer 66 when the font is positioned at the opposite side of the hammer to make a printing of the symbol at the lowest print column.

After finishing the printing at the lowest order column, printing of columns for a numerical value is to be made. But, by making a single-column no-printing zone between the symbol printing zone 67 and the numerical printing zone 68, as shown in FIG. 12B, it is easier to see a printed line distinguishing the abovementioned two zones. Therefore, after printing the lowest order column, an adjacent higher order column position is skipped (to be described later in detail), and the hammer 66 is moved to a further higher printing column which is indicated by dotted lines in FIG. 12A. Thus, when a digit '3' is to be printed next, a printing font 21 for the digit '3' is designated in the second font group G2 which is the nearest to the first font group G1 in relation to the movement of the endless printing belt 3 (a movement distance of the belt can be the minimum). Then, a movement distance between the printing font 21S which was at the opposite side of the hammer 66 at the time of the reference position detection and the designated font 21 in the second font group G2 is added to calculate to a distance which is equivalent to a width of two printing columns by a processing in the control section, and the resultant distance $l_2$ is obtained. A movement of the endless printing belt 3 in circulation is measured by counting signals generated using the position detection section 19, and when the printing font 21 for printing the digit '3' is positioned at the opposite of the hammer 66, the font is struck against the printing paper by the hammer.

When digit '3' is desired to be printed again at the adjacent higher order printing column, a printing font for the numeral '3' is selected in the third font group G3 which is the nearest to the second font group G2 in relation to the belt movement. And, the movement distance $l_3$ is calculated by adding a movement distance between the font 21S which was located at the opposite position of the hammer 66 at the time of the reference position detection and the font 21 selected in the third font group G3 to a distance which corresponds to a single-column shift of the hammer 66. Based on the resultant calculation sum, the movement of the endless printing belt is measured and the printing of the digit '3' is made by the selected font. As is described above, to complete a whole line of printing, every time a desired font is selected in reference to the font 21S which was at the opposite position of the hammer 66 at the time of the reference position detection, the movement distance of the endless printing belt 3 which is necessary to locate the selected font at the hammer position is calculated in principle. But, in practice, as the movement distance which was necessary to locate the font for the printing in the next lower order column at the position opposite to the hammer is already known, the movement distance for the subsequent printing is calculated based on the known distance.

Figure 13:
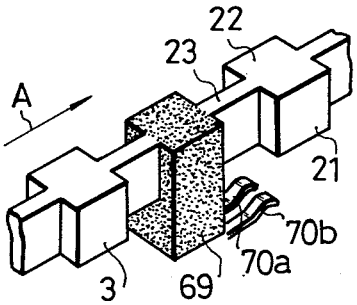
FIGS. 13 and 14 are perspective views magnified showing a part of an alternative embodiment of the reference position detection section.
Figure 14:
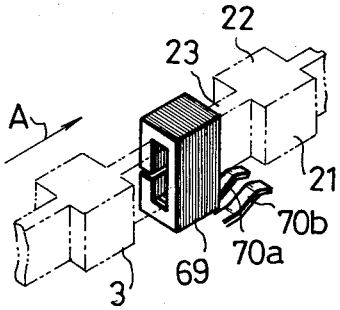

FIGS. 13 and 14 are drawings for showing two alternative embodiments of the reference position detection means. The reference position detection means according to an alternative embodiment shown in FIG. 13 consists of an electric-conductive and slidable contact section 69 for detecting the reference position, made of an electric-conductive rubber or plastic, which is molded together as a part of the endless printing belt 3 when it is molded. This slidable contact section 69 is projected downwardly a little from the level of the lower surfaces of the printing fonts 21 and the belt teeth section 22, and it makes contacts with the two fixed contact blades **70*a* and 70*b* which are positioned on a circulating locus of the moving slidable contact section 69 and under the mentioned contact section. Therefore, when the two fixed contact blades 70*a* and 70*b* are passed by the moving slidable contact section 69 above them as the endless printing belt 3 is rotated, the fixed contact blades 70*a* and 70*b* make an electric connection by means of the electric-conductive property of the slidable contact section between the two, and thus the reference position of the endless printing belt 3** can be detected.

The reference position detection means according to another alternative embodiment which is shown in FIG. 14 is consisting of an electric-conductive and slidable contact section 69 which is made of a metal piece for the detection of the reference position, and the metal piece is fixed to a certain position on the endless printing belt 3 by pressing the both sides, the front and rear, of the metal piece. Similarly as explained for the reference position detection means shown in FIG. 13, the lower end of the slidable contact section 69 is projected a little from the level of the lower surfaces of the printing font section 21 and the belt teeth section 22, and it makes contacts with the fixed contact blades **70*a* and 70*b*** which are positioned under the moving slidable contact section and with a certain gap between the two blades.

As a still further embodiment, the reference position detection means can be realized by using a photosensor of a reflection type or transmission type which is provided near the endless printing belt 3 for photoelectrically detecting the reference position or the movement distance of the printing belt. A description of the printing/column-shifting mechanism will be given below.

Printing/Column-shifting Mechanism

Figure 2:
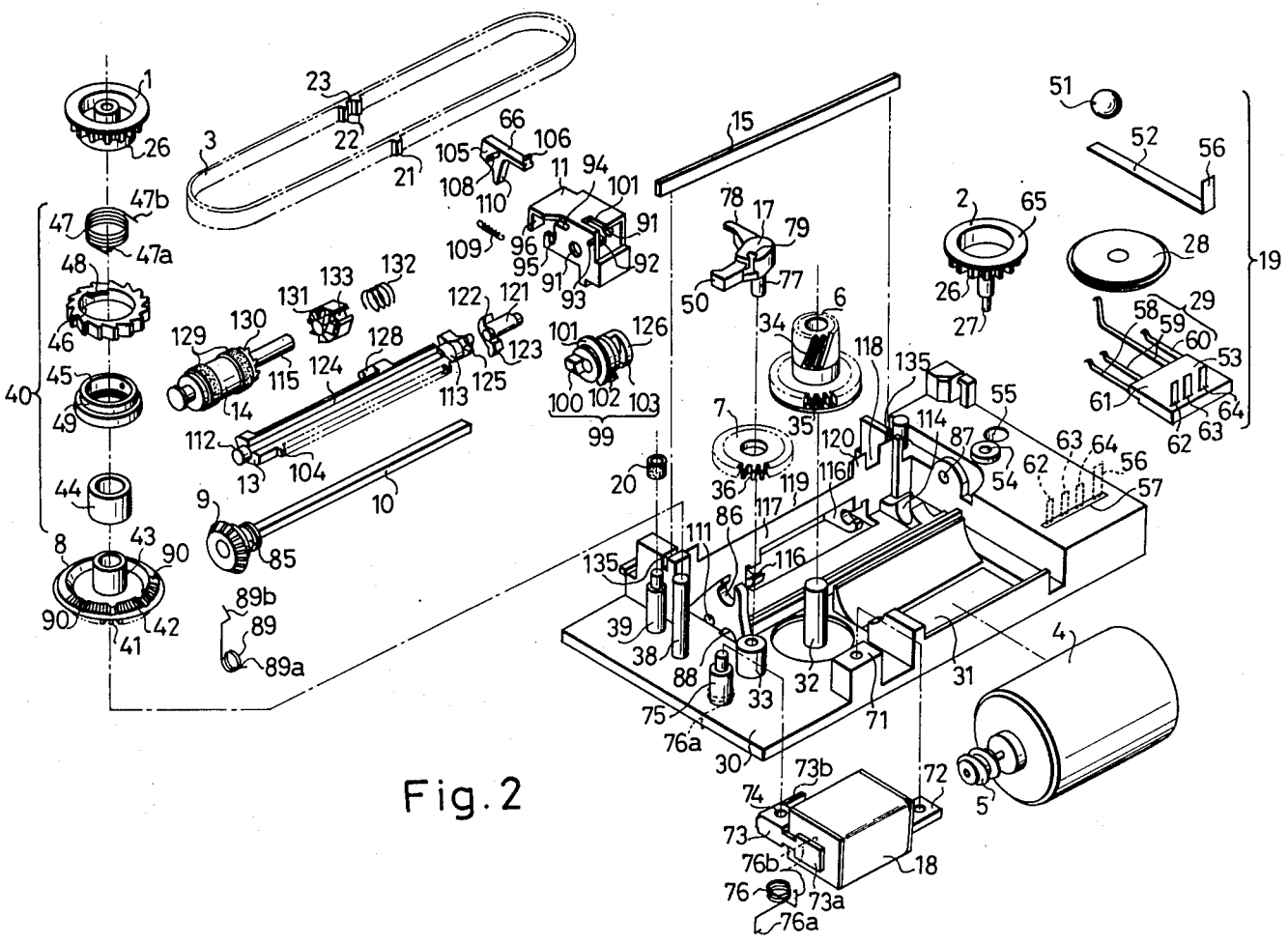
FIG. 2 is a perspective view of a printer mechanism with disassembled components.

As shown in FIG. 2, at the left side of the motor installation convex section 31 and on the near end to the front edge of the base 30, a solenoid mounting bench 71 is projected upward, and the electro-magnetic solenoid 18 is mounted on the solenoid mounting bench 71 by means of the fixing piece 72 which is projected from the solenoid assembly. An actuator 73 of the electro-magnetic solenoid 18 is L-shaped in a plane view, and between its base-end section **73*a* and its free-end section 73*b*, a flat platform section is provided on which a pass-through hole 74 is drilled. On the other hand, at the left of the gear holding cylinder 33, an actuator holding shaft 75 is standing on the base 30, and its upper smaller-diameter section is inserted into the abovementioned pass-through hole 74, so that the actuator 73 which is pivoted by the holding shaft 75 is movable through a certain rotational angle. Around the lower larger-diameter section of the actuator holding shaft 75, an actuator spring 76 of a coil type is set, and its one end 76*a* is fastened to an edge of the base 30 as shown by dotted lines, and the other end 76*b* is fastened to the base end 73*a* of the actuator 73** as shown by dotted lines also.

Extending downwardly from the selection lever 17 is a lever rotation shaft 77, and the shaft 77 is inserted into the center hole of the gear holding cylinder 33. The selection lever 17 is provided with, in addition to the first dog 50 which interlocks with the abovementioned ratchet 46 for the font position selecting, a second dog section 78 which interlocks with the printing/column-shifting gear 9, and a vertical slot 79 into which the free end 73*b* of the abovementioned actuator 73 is inserted with a small amount of clearance.

Figure 15:
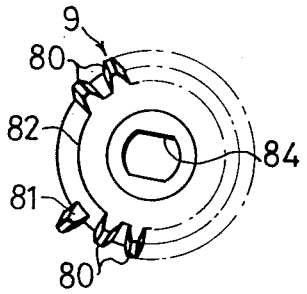
FIG. 15 is a front view of the printing/column shifting gear.
Figure 16:
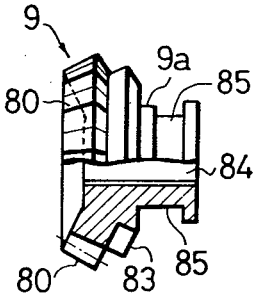
FIG. 16 is a right-side view showing a cross-sectional part of the gear shown in FIG. 15.
Figure 17:
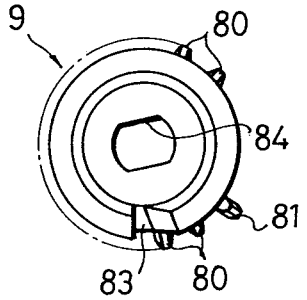
FIG. 17 is a rear view of the gear shown in FIG. 15.

Next, the shape of the printing/column-shifting gear 9 will be described in reference to FIGS. 15 to 17. FIG. 15 shows a front view of the printing/column-shifting gear 9. FIG. 16 is a partial cross-sectional drawing of it viewed from the right side. And, FIG. 17 is a rear view of it. The printing/column-shifting gear 9 is provided with a front teeth section 80 and a rear tooth section 81 which are arranged in front-and-back relationship relative the axis of the shaft 10. The front teeth section 80 has a no-tooth section 82 in its circumference direction (in a range of radial 60°) as shown in FIG. 15; and on the other hand, the rear tooth section 81 has only one tooth which is provided at the rear side of the abovementioned no-tooth section 82, as shown in FIG. 15. On the rear tooth section 81, no other tooth is provided except the single tooth, but near the single tooth of the rear tooth section 81, a cut section 83 is formed into which the second dog 78 of the selection lever 17 may fall into. At the center of the gear 9 along the axis of the shaft 10, an oval hole 84 is formed therethrough, and one end of the printing/column-shifting shaft 10 which has an oval cross-sectional shape is forcedly fixed in the oval hole of the gear. At the rear tooth section 81 of the printing-/column-shifting gear 9, a cylindrical section is provided having on its circumference a circle slot section 85, as shown in FIGS. 2 and 16. By placing the circle slot section 85 into the half-cut bearing section 86 which is formed on the base 30, and inserting the far end of the printing/column-shifting shaft 10 into the bearing 87 which is provided on the base 30, the printing/column-shifting shaft 10 is rotatably held on the base 30.

As shown in FIG. 2, at a lower side of the abovementioned shaft bearing section 86, a spring holding pin 88 projected horizontal, and around the pin a gear spring of coil spring 89 of a coil type. As is also shown in FIG. 18A, the gear spring 89 which is set around the spring holding pin 88 has one end 89*a* pressedly against a vertical cut wall of the base 30 as shown in the figure, and its free end 89*b* is pressedly contacting with the surface of the cam section 9*a* which is adjacent to the circle slot 85 formed on the printing/column-shifting gear 9.

This printing/column-shifting gear 9 interlocks with the frustoconical-type teeth section 42 of the main gear 8 at a certain timing. The frustoconical teeth section 42 has radial slots 90 formed on it which are positioned at each 1/9-section of the circumference of the gear, and between a radial slot 90 and a next radial slot 90, a part of the teeth section 42 is formed at the near side to the inner circumference of the teeth section, as shown in FIG. 7.

Now, a switching of driving-force transmission between the main gear 8 and the driving pulley 1 and the main gear 8 and the printing/column-shifting shaft 10 will be described. FIGS. 18A, 18B, and 19 show a condition where the driving force is being transmitted from the main gear 8 to the driving pulley 1. In other words, as the electro-magnetic solenoid 18 is not activated in this condition, the base end 73*a* of the actuator 73 is being pulled by the actuator spring 76. Thus, the actuator 73 which is pivoted with the actuator holding shaft 75 at its center is being rotated in the clockwise direction, and the vertical insertion slot 79 of the selection lever 17 is being pulled to the front side on FIG. 2 by the free end 73*b* of the actuator 73. By this pulling force, the selection lever 17 is being rotated in the counterclockwise direction centered by its rotation shaft 77; the second dog 78 falls in the cut slot section 83 of the printing/column-shifting gear 9, as shown in FIG. 18A; and on the other hand, the first dog 50 is not interlocked with the teeth section of the ratchet 46 for the font position selecting, as shown in FIG. 19.

Figure 18A:
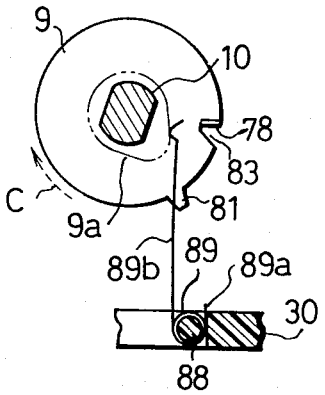
FIGS. 18A and 18B are drawings showing arrangement conditions of the printing/column shifting gear.
Figure 18B:
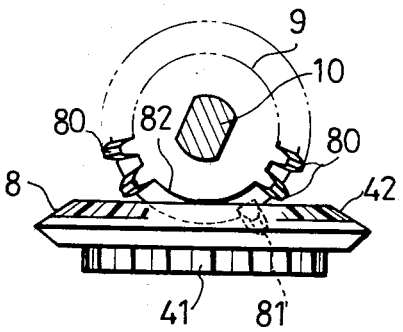
Figure 19:
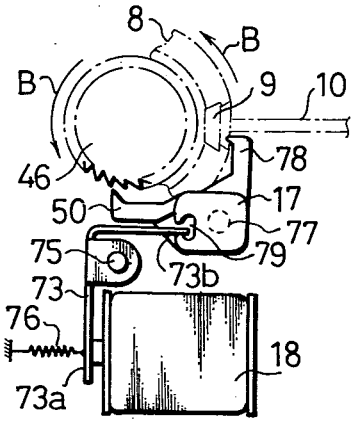
FIGS. 19 and 20 are drawings showing a movement operation of the selection lever.

FIGS. 18A and 18B show a condition wherein the printing/column-shifting gear 9 is positioned in the same place. Further, in FIG. 18B, the center cylindrical section 43 of the main gear 8 is omitted from illustration, in order to clearly show the condition of the printing-/column-shifting gear 9. That is, when the second dog 78 of the selection lever 17 is placed into the cut slot section 83 of the printing/column-shifting gear 9, the no-tooth section 82 of the printing/column-shifting gear 9 faces the modified shaped teeth section 42 at the opposite side, and the single tooth of the rear tooth section 81 is not interlocked with one of the radial slots 90. Therefore, as there is no interlocking relationship between the main gear 8 and the printing/column-shifting gear 9 and the first dog 50 is apart from the font position selecting ratchet 46, the rotating driving force of the main gear 8 is transmitted to the driving pulley by means of the spring clutch 40. Thus, the driving pulley 1 rotates in the same direction, shown by an arrow B, as that of the main gear 8 to circulate the endless printing belt 3, so that the reference position detection and a font selection based on the reference position detection are performed.

Figure 20:
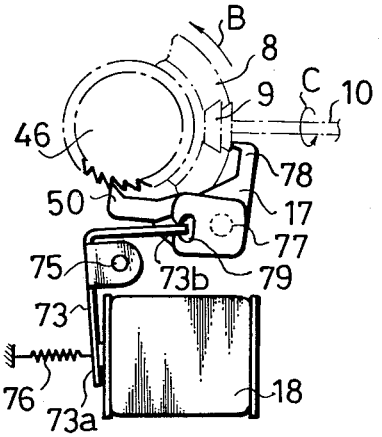

An instruction is output by the control section for selecting a desired font 21, and based on the instruction the electro-magnetic solenoid is activated to excite itself. This excitation pull the base end 73*a* of the actuator 73 to the electro-magnetic solenoid 18 against the spring force of the actuator spring 76, as shown in FIG. 20, and thus the actuator 73 and the selection lever 17 rotate in the counterclockwise direction and in clockwise direction, respectively. By this rotative motion of the selection lever 17, the second dog 78 releases from its interlocking relation with the cut slot section 83 of the printing/column-shifting gear 9, and instead the first dog 50 interlocks with the teeth section of the font position selecting latcher 46. Thus, a rotation of the latchet 46 is interrupted; the driving force transmission to the driving pulley 1 is interrupted by the action of the spring clutch 40; and a selected font 21 is held at the position opposite the hammer 66.

When the second dog 78 is released from the cut slot section 83 of the printing/column-shifting gear 9, as shown by an arrow C in FIG. 18A, the printing-/column-shifting gear 9 is rotated a little by the spring force of the gear spring 89. Then, the single tooth of the rear tooth section 81 falls into a radial slot 90, and the single tooth is moved in rotation by the main gear 8 to rotate the printing/column-shifting gear until the front teeth section 80 interlocks with the modified frustoconical teeth section 42; and the rotation force of the main gear 8 is transmitted to the printing/column-shifting shaft 10 by means of the printing/column-shifting gear 9 in rotate the shaft to the direction indicated by an arrow C in FIG. 20.

Figure 21:
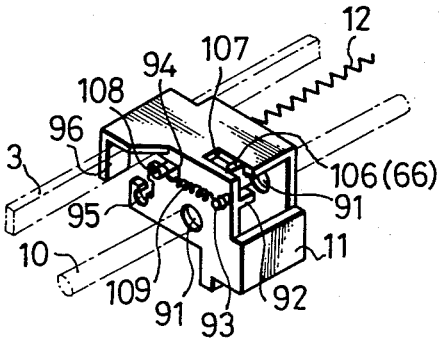
FIG. 21 is an angled view of the hammer holder.
Figure 22:
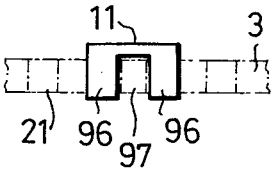
FIG. 22 is a front view showing a part of the hammer holder.
Figure 23:
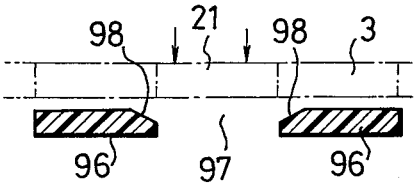
FIG. 23 is a magnified cross-sectional plane view of the isolation wall section provided on the hammer holder.

The hammer holder 11 which is slidably mounted on the printing/column-shifting shaft 10 is formed with lateral pass-through holes 91 in its side plates into which the printing/column-shifting shaft 10 is rotatably inserted, and on the upper inside of the hammer holder 11 a hammer mounting section 92 is horizontally extending from the left-side plate, as shown in FIG. 21. A spring hooking pin 93 projects laterally outwards from the left-side plate, and in the hammer striking direction, a horizontal slot 94 is cut in the left-side plate, as shown in FIGS. 2 and 21. An the front lower direction of the slot 94, a lever suspension section 95 is formed in an inverse Ω-shape on the left-side plate. The same type of cut 95 is also formed on the right-side plate. At the front side of the hammer holder 11, an isolation wall section 96 is provided. On this isolation wall section 96, as shown in FIG. 22, a large opening 97 is formed in the middle into which a selected font 21 can be projected, and the isolation wall section is provided laterally of the opening 97. Further, as shown in FIG. 23, by forming a tapered section 98 inside the isolation wall section 96 at the left and right edges of the projection opening 97, a selected font can be smoothly projected into the opening 97.

Figure 24:
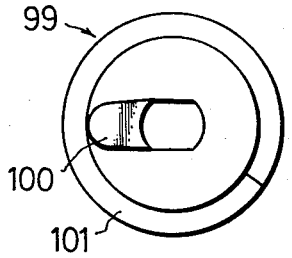
FIG. 24 is a front view of the column shifting cam section.
Figure 25:
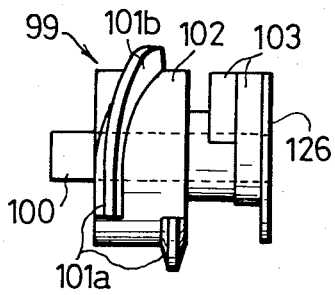
FIG. 25 is a side view of the cam section shown in FIG. 24.
Figure 26:
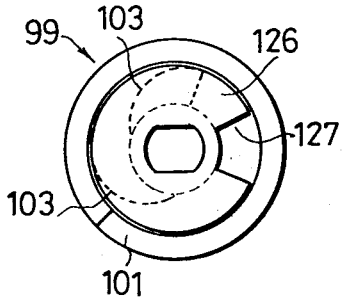
FIG. 26 is a rear view of the cam section shown in FIG. 24.
Figure 27:
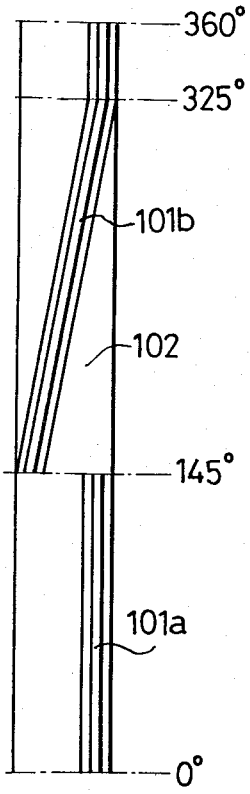
FIG. 27 is a developement of a surface of the cam section.

Under the abovementioned hammer mounting section 92 of the hammer holder 11, the column-shifting-/paper-feeding cam 99 which is spline-coupled with the printing/column-shifting shaft 10 is installed. As shown in FIGS. 24 to 26, the cam 99 consists of a lateral hammer driving section 100 which extends outwardly from the center toward the outer circumference, a column-shifting cam section 102 which has a single projected 'belt-shape' cam 101 on the circumference, and an oval rack rotation section 103 for restoring the rack for paper feeding, and these sections are plastic-molded as a single piece. FIG. 27 shows a development of the cam section 101 in which the abovementioned single 'belt-shape' cam 101 is shown as consisting of a circumferencial projected belt section 101*a* which extends along the circumference direction covering about a half of the outer circumference, and a spiral projected belt section 101*b* which splirally extends over the remaining half circumferencial section, and these projected belt sections are in a single connection. The projected belt section of the cam 101 interlocks with the rack teeth 104 which are formed in an equal pitch on a single side of the rack 13.

The hammer 66 is mounted on the hammer mounting section 92 with the striking section 105 postioned at the side of the isolation wall section 96, and a projection 106 on the hammer is slidably inserted in the guide slot 107 which is cut on the upper plate of the hammer holder 11. On a single side of the hammer 66, a spring hooking pin 108 is projected, and as shown in FIG. 21, this spring hooking pin 108 is extending outward in the slot 94 of the hammer holder 11. A coil spring 109 is hooked between the spring hooking pin 93 of the hammer holder 11 and the spring hooking pin 108 of the hammer 66, and by the pulling force of the spring, the hammer 66 is being held in a manner that the hammer 66 sits apart from the endless printing belt 3, i.e., it is being pulled in the direction reverse to its striking. Under the spring hooking pin 108, an arm section 110 is provided onto which a hammer driving section 100 of the cam 99 makes a contact by the rotation of the column-shifting-/paper-feeding cam 99.

FIGS. 28 and 29 are the drawings for explaining printing operation; FIG. 28 illustrates a condition before making a printing, and FIG. 29 illustrates a condition after making a printing. Before printing, as shown in FIG. 28, the hammer 66 is being pulled backward by the coil spring 109, and its position is determined by a stopper which is not shown. Therefore, the endless printing belt 3 (font section 21) is in between the isolation wall section 96 of the hammer holder 11 and the striking section 105 of the hammer 66, and is spaced a small distance from the striking section 105. The hammer driving section 100 is in a position downward, and it is not in contact with the arm 110 of the hammer 66.

The printing/column-shifting shaft 10 makes a single rotation in the direction shown in an arrow C as the driving force is transmitted from the main gear 8, so that a printing operation is made in a first half of the rotation, and a column-shifting operation is made in a continuous manner to the previous printing operation in a second half of the rotation. That is, as the printing-/column-shifting shaft 10 rotates in the direction shown by an arrow C, the column-shifting/paper-feeding cam 99 which is spline-coupled on the shaft rotates together therewith. In the first half of the rotation, as the circumferencial 'belt-shape' cam 101*a* is interlocking with the rack teeth 104, the column-shifting/paper-feeding cam 99 is not shifted and simply turns a half circle (with the hammer holder 11 and the hammer 66 mounted above the cam 99 staying at the same position). During this half rotation of the column-shifting/paper-feeding cam 99, the hammer driving section 100 makes a contact with the arm 110 of the hammer 66 as shown in FIG. 29, and in the subsequent half rotation of the hammer driving section 100 the hammer 66 is projected foreward against the pulling spring force of the coil spring 109. Thus, a selected font 21 which is at the opposite of the printing paper face is struck at its rear end to be projected foreward to make a printing on the paper 16. Due to the projection opening 97 being provided in the isolation wall section 96 as shown in FIG. 22, unnecessary printing such as a side-printing can be avoided. With the continued rotation of the printing/column-shifting cam 99, the hammer driving section 100 moves upward in rotation from the horizontal position as shown in FIG. 29, the hammer 66 is pulled backward by the pulling force of the coil spring 109, and its front face separates from the rear end of the selected font 21 of the endless printing belt 3. In this reciprocal motion of the hammer 66, the hammer is properly guided by means of the hammer mounting section 92, sliding of the projection 106 in the guide slot 109, and sliding of the spring hooking pin 108 in the longer slot 94.

As the printing/column-shifting cam 99 continuously rotates, now the previously mentioned spiral projection cam 101*b* interlocks with the rack teeth 104; along with the rotation of the cam 99, the hammer holder 11, hammer 66, and the printing/column-shifting cam 99 are moved (to the left side on FIG. 1), against the spring force of the hammer return spring 12, to make a column shifting.

Thus in a manner as described above, the font selection, printing, and column-shifting operations are repeatedly performed, and a single-line printing on the paper is made.

In FIG. 2, a hole 111 is drilled below the bearing section 86 for receiving the rack, and into it a single end 112 having a round cross-sectional shape of the rack 13 is rotatably inserted. On the other hand, into a rack receiving convex section 114, having a half-circle shape, and provided below the bearing 87, the other end of the rack 13 is rotatably set, for defining the position of the rack 13. At the rear side of the rack receiving hole 111 and the rack receiving convex section 1 14, an upwardly standing paper guide wall section 117 is provided and at the lower end of which two arms 116 are provided with a certain distance between them for rotatably suspending the two ends of the paper-feed shaft 115.

FIGS. 30A and 30B are a partial front view showing a shape of the upper part of the paper guide wall 117 and a partial front view of a printing paper which is printed by an embodiment of the present invention, respectively. As previously mentioned, by providing a certain distance between the lower order column 67 for printing symbols and the higher order columns 68 for printing numerals, for example by a distance of a single column, the two printing zones can be clearly distinguished. Therefore, At the upper part of the paper guide wall 117, a mask section 120 is provided with a width of a single-printing column, between the cut section 118 for printing of symbols at the printing zone 67 and the cut section 119 for printing numerals at the printing zone 68. The hammer 66 stops at the position opposite the abovementioned mask section 120 while it moves from the printing zone 67 at the lowest order column to the printing zone 68 of higher order columns, and makes the same operation as the normal printing operation. But, since the font which is projected foreward by the hammer 66 is stopped by the mask section 120, thus no printing takes place. A font which is struck at the no-printing zone is a one which is located a little foreward in rotation to the font selected at the higher order printing zone. A description of the hammer-holder return/paper-feeding mechanism will be given below.

Hammer-holder Return/Paper-feeding Mechanism

Figure 31:
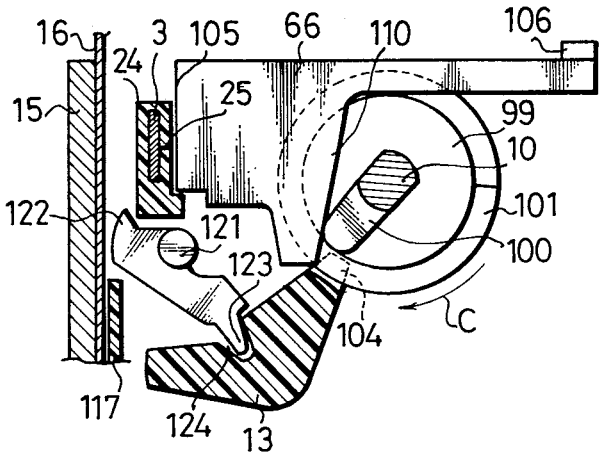
FIGS. 31 and 32 are side views of the major elements of the rack, for explaining a rotational operation of it.
Figure 32:
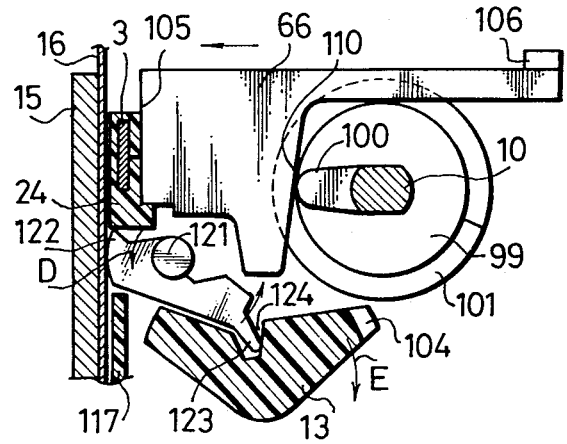

Upon completing a single-line printing as above-described, it is necessary to return the hammer holder 11 to the home position again and to prepare for the printing of the next line. In the previous section on 'Printing/Column-shifting Mechanism', a description is omitted, but both ends of a rack-release lever 121 are rotatably suspended on the lever suspension sections 95 of the abovementioned hammer holder 11. On the rack-release lever 121 are provided a dog 122 which is projected upward and a slidable projection 123 which is projected downward. As shown in FIGS. 31 and 32, the rack-release lever 121 is positioned between the hammer 66 and the rack 13; and before the rack 13 rotates, the abovementioned dog 122 is positioned at the lower front side of the endless printing belt 3, as shown in FIG. 31. On the other hand, the abovementioned slidable projection 123 is inserted in the fastening slot 124 which is formed along the longer direction on the rack 13, and as the hammer holder 11 is moved the slidable projection 123 slides in the fasting slot 124.

FIG. 31 shows a condition before the hammer-holder return is started. In this condition, the pushing-down element 24 is selectively positioned at a place to face the hammer 66; as the pushing-down element 24 is projected downward a little below the endless printing belt 3, the upper tip of the dog 122 is positioned behind and a little above the lower end of the pushing-down element 24. Similarly as in the normal printing operation, the hammer driving section 100 is rotated to the direction indicated by an arrow C, and thus the pushing-down element 24 is pushed towards paper 16 by means of the hammer 66. Along with this horizontal movement of the pushing-down element 24, the rack-release lever 121 rotates in the direction indicated by the arrow D as shown in FIG. 32; and as the slidable projection 123 of the rack-release lever 121 and the fastening slot 124 of the rack 13 are interlocking, the rack 13 is rotated in the direction indicated by an arrow E along with the rotation of the abovementioned rack-release lever 121. The rack 13 which is thrown in the direction indicated by the arrow E is kept as it is until the rack rotation section 103 is restored to the original position as will be described later. Thus, the rack teeth 104 separates from the belt-shaped cam 101 of the printing/column-shifting cam 99, and the interlocking relation between the rack 13 and the printing/column-shifting cam 99 is released. Thus, the hammer holder 11 which has the hammer 66, the printing/column-shifting cam 99, and the rack-release lever 121 starts to return to the home-position side along the printing/column-shifting shaft 10 by the pulling force of the holder-return spring 12.

As shown in FIG. 2, at the right end of the rack 13, a paper-feeding intermediate-lever section 125 is provided which is formed with 2 peaks extending outwardly from different axial positions along the rack. On the other hand, as shown in FIGS. 2, 25, and 26, at a single end of the rack rotation section 103 of the column-shifting/paper-feeding cam 99, an intermediate stopper section 126 is provided in integrated structure with the cam 99, and it has almost a round disk shape. At a certain position of the disk, a larger fan-shaped cutting section 127 is formed, as shown in FIG. 26, into which the paper-feeding intermediate-lever section 125 of the abovementioned rack 13 can be inserted. Therefore, when the hammer holder 11 returns to the home-position side, the side face of the paper-feeding intermediate-lever section 125 opposite the rack teeth 104 and the outer face of the intermediate stopper section 126 make a contact, and the movement of the hammer holder 11 is stopped. Thus, because the hammer holder 11 is stopped at an intermediate position near the home position, the rack rotation section 103 of the column-shifting/paper-feeding cam 99 and the paper-feeding intermediate-lever section 125 of the rack 13 are not facing each other.

Figure 33:
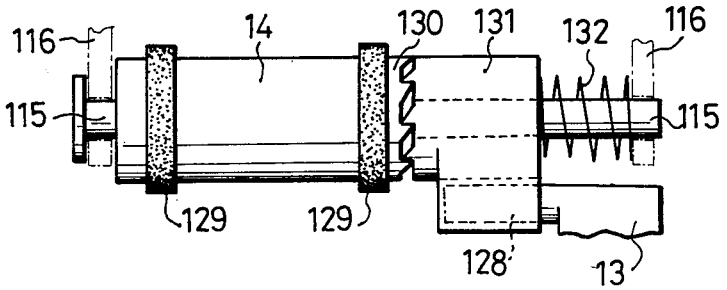
FIG. 33 is a plane view of the major elements of the paper feeding section.
Figure 34:
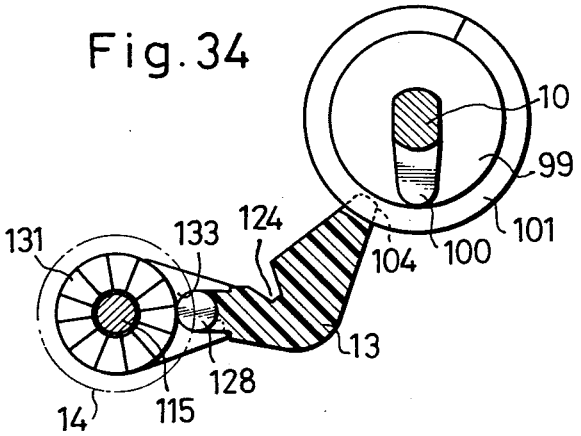
FIGS. 34 and 35 are drawings showing a paper feeding operation.
Figure 35:
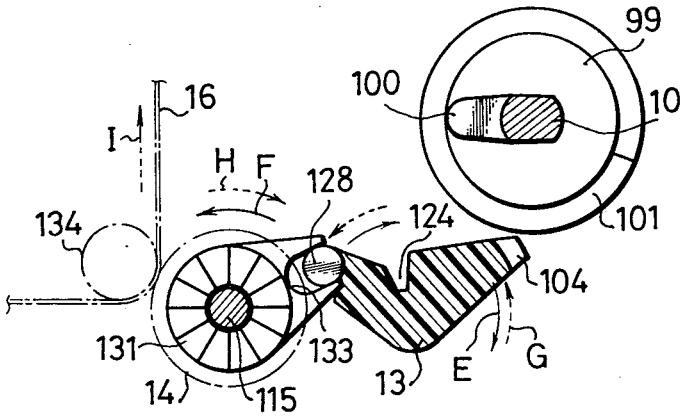

Along with the hammer-holder return operation, the paper-feeding operation is made in parallel, and a description of this paper-feeding operation will be given below. As shown in FIG. 2, at the opposite side of the rack teeth 104 of the rack 13, the hooking pin 128 is projected in parallel to the direction of the axis of the rack 13. At the rear side of the rack 13, the paper feeding shaft 115 is positioned in parallel to the rack 13, and a paper-feeding roller section 14 is fixed at the left half of the shaft 115, on which two rubber rings 129 are pressed with a certain interval between the two rings. As shown in FIGS. 2 and 33, at the right-side end of the paper-feed roller section 14, a driven paper-feed ratchet 130 is fastened which is facing a driving paper-feed ratchet 131 that is rotatably held around the paper-feeding shaft 115. The driving paper-feed ratchet 131, as shown in FIG. 33, is pushed in the direction to normally interlock with the driven paper-feed ratchet 130 by means of a coil spring 132 which is placed between the driving paper-feed latchet 131 and the arm 116. As shown in FIGS. 2, 34, and 35, a single side of the circumference of the driving paper-feed ratchet 131 is projected outward and a pin-insertion hole 133 is formed into which the hooking pin 128 of the abovementioned rack 13 is rotatably inserted in a horizontal plane. At the upper left direction of the paper feeding roller 14 of FIG. 35, a driven roller 134 is arranged which rotates following the rotation of the paper-feeding roller 14, and a printing paper 16 is placed in between the paper-feeding roller 14 and the driven roller 134.

FIG. 34 shows a condition before the paper feeding is started. In this condition, operations such as font selection and printing/column-shifting have already been made, and thus the rack 13 and the column-shifting/paper-feeding cam 99 are interlocked each other.

As previously described, when the rack 13 is rotated to the direction shown by an arrow E as indicated in the solid line in FIG. 35 according to the hammer-holder return operation, the driving paper-feed ratchet 131 rotates a certain angle in the direction shown by an arrow F as indicated by the solid line with a center at the paper-feeding shaft 115, by means of the hooking between the hooking pin 128 and the pin slot 133. In this rotation in the direction indicated by the arrow F, the teeth of the driving paper-feed ratchet 131 and the driven paper-feed ratchet 130 have teeth forms that they do not interlock each other; when the rack 13 is fully thrown, the pin slot 133 of the driving paper-feed ratchet 131 stops at a position as shown in FIG. 35, and it is in a waiting condition for paper feeding.

On the other hand, because the interlocking between the rack teeth 104 of the rack 13 and the column-shifting/paper-feeding cam 99 is released as the rack 13 rotates, the hammer holder 11 rapidly returns to the home position by the pulling force of the abovementioned holer-return spring 12. Further, when the hammer holder 11 returns from a lower order column to the home position, in a middle of the remaining ¾-rotation of the column-shifting/paper-feeding cam 99 the hammer holder 11 reaches near the home position; but, as the intermediate stopper section 126 of the column-shifting/paper-feeding cam 99 makes a contact with the side face of the paper-feed intermediate-lever section 125 of the rack 13 during the rotation of the column-shifting/paper-feeding cam 99 in this case, the rack rotation section 103 and the paper-feed intermediate-lever section 125 are not facing each other; thus, the rack 13 is not pushed up by the rack rotation section 103; and the fully-thrown condition of the rack 13 and the waiting condition of the driving paper-feed ratchet 131 are kept as they are, as shown in FIG. 35. And, upon a full rotation of the column-shifting/paper-feeding cam 99, the fan-shaped cutting section 127 of the intermediate stopper section 126 faces with the paper-feed intermediate-lever section 125 of the rack 13, and at this time first, the hammer holder 11 is able to fully return to the home position.

As described above, when a full rotation of printing-/column-shifting shaft 10 is completed for a hammer-holder return (at this time, already the electro-magnetic solenoid is in deactivated condition), the second dog 78 of the selection lever 17 falls into the cut section 83 of the printing/column-shifting gear 9, as shown in FIG. 18A, by the spring force of the actuator spring 76, and thus the printing/column-shifting gear 9 (with the printing/column-shifting shaft 10) is not rotated, keeping its still condition.

At the same time, the first dog 50 of the selection lever 17 is released from the interlocking with the teeth of the font position selection latchet 46, and the rotation driving force of the main gear 8 is transmitted to the driving pulley 1 to circulate the endless printing belt 3. Further, as the interlocking between the rack teeth 104 of the rack 13 and the column-shifting/paper-feeding cam 99 is released during this circulation of the endless printing belt 3, a time for the above-mentioned hammer-holder return can be sufficient. And then, the pushing-down element 24 is moved to the position which is facing the hammer 66 at its opposite side; the electro-magnetic solenoid 18 is activated at the time when the pushing-down-element 24 faces the hammer 66; and as previously described, by a ¼-rotation of the printing-/column-shifting shaft 10 the pushing-down element 24 is pushed foreward by the hammer 66 as shown in FIG. 32. A difference with a case of the hammer-holder return operation is that, as the rack 13 had previously been thrown in the direction E and the driving paper-feed ratchet 131 is in a waiting condition for paper feeding, only the pushing-down element 24 moves back and forth. On the other hand, the hammer holder 11 has been moved by the pulling force of the holder-return spring 12 and is fully returned to the home position at this time; the rack rotation section 103 of the column-shifting/paper-feeding cam 99 and the paper-feed intermediate-lever section 125 of the rack 13 are in a condition in which they are able to link (or interlock) each other. Therefore, as the column-shifting/paper-feeding cam 99 continuously rotates, the rack rotation section 103 strikes the paper-feed intermediate-lever section 125; and the thrown rack 13 is turned in the direction shown by an arrow G indicated by dotted line in FIG. 35 by means of the paper-feed intermediate-lever section 125. By this rotational movement, the rack 24 restores itself to its original position, to cause interlocking between the rack teeth 104 and the belt cam section 101 of the column-shifting/paper-feeding cam 99, and the driving paper-feed ratchet 131 rotates in the direction shown by an arrow H along with the rotation of the rack 13. The driving paper-feed ratchet 131 and the driven paper-feed ratchet 130 have teeth shapes that they can interlock each other when the driving paper-feed ratchet 131 rotates to the direction shown by the arrow H; the paper-feed roller 14 also rotates to the direction shown by the arrow H; and thus, the paper 16 is pushed to the direction shown by an arrow I to make paper feeding of a half-line space.

When the column-shifting/paper-feeding cam 99 has made a single rotation, a switching of the driving force transmission is made by means of the selection lever 17, and the endless printing belt rotates to position the pushing-down element 24 at the opposite side of the hammer 66. And, while the column-shifting/paper-feeding cam 99 makes a full rotation, the rack 13 moves reciprocally in the two directions shown by arrows E and G as shown in FIG. 35; thus the driving paper-feed ratchet 131 (with the paper-feed roller 14) rotates to the direction shown by an arrow F to place itself in a waiting condition for paper feeding; and thus as the driving paper-feed ratchet 131 rotates to the direction of the arrow F still further, the paper 16 is pushed to the direction shown by an arrow I to make paper feeding of the remaining half-line spacing.

In a abovedescribed embodiment of the present invention, the paper-feed roller 14 is rotated twice to make a complete single-line spacing of the printing paper, but by making the diameter of the paper-feed roller 14 larger a complete single-line spacing may be made, for example, by only a single rotation of the paper-feed roller.

As shown in FIG. 35, the printing paper 16 which is fed by the joint motion of the paper-feed roller 14 and the driven roller 134 is pushed up in a gap between the guide plate 15 and the paper guide wall 117, as shown in FIG. 28 for example, to place the next printing line at the level of the hammer position. As previously described, the paper guide wall 117 is formed as the integrated body of the base 30, but as shown in FIG. 2, the guide plate 15 is forcedly inserted into the guide plate holding slots 135 at both ends of the guide plate 15, which are formed at the upper rear portion of the paper guide wall 117, so that the guide plate is firmly placed. This guide plate 15 is made of a thick metal plate, and serves the role of a platen.

The tolerance between the printing/column-shifting shaft 10 and the column-shifting/paper-feeding cam 99 is made minimum in their design. Thus, when a printer system according to the present invention is used in a lower temperature condition, for example, the return of the hammer holder 11 may become slower and it takes a little longer time. In this printer system, a font selection operation is made during the time between the start of the return of the hammer holder 11 and the pushing up of the thrown rack, and thus enough time is allowed until the hammer holder returns to the home position. Further, as it is structured that the the rack 13 is not rotated to the position which is able to make a column shift when the hammer holder 11 (with the column-shifting/paper-feeding cam 99) is not fully returned to the home position, the rack 13 will not rotate in a middle of a return of the hammer holder 11, nor interrupt the return motion of the hammer holder 11 by interlocking between the rack 13 and the column-shifting/paper-feeding cam 99 at a middle position.

As described above, a printer system according to the present invention is characterised in comprising, an endless printing belt on which a number of fonts are arranged on its outer surface; driving means for circulating in motion said printing belt; paper feeding mechanism for feeding a printing paper positioned at the opposite side of the fonts arranged on the outer surface of said endless printing belt; hammer means provided at the inner side of said circulating endless printing belt, for striking a selected font onto a printing paper, whereby the selected font is pushed foreward to the perpendicular direction to a surface of the printing paper; a single driving source; and clutch means which is provided between the single driving source and the mechanisms for driving the endless printing belt and the hammer means, whereby said endless printing belt and the hammer means are selectively driven by means of said clutch.

Thus, a printer system according to the present invention, which is structured as described above, is a printer of compact size and light weight, and produces little noise during printing.

As described above, a printer system according to the present invention is characterized in arranging a printing paper at the opposite side of the fonts which are arranged on the outer surface of the endless printing belt that carries a number of fonts; a carriage which is moved laterally to the direction of movement of the surface of the printing paper; said carriage being placed at the inside of the circulating endless printing belt and being mounted on it with a hammer mechanism for striking a selected font at its rear end to make a printing on the printing paper; said carriage having a mask body with a front projection opening which has almost the same size of a single face of a font; said mask body having the isolation wall section extending to the both sides of the font projection opening which is hanging in front of the hammer mechanism in between the printing paper and the endless printing belt.

Thus a printer system according to the present invention, due to the structure of the above description, is able to prevent side-printing, even with a printer which uses an endless printing belt, by a simple mechanism, and therefore the fabrication cost of the printer system can be saved. Further, as a selected font is correctly positioned at an accurate printing column, a number of advantages can be realized including keeping higher accuracy of printing positions and fine finishing of printed result.

As described above, a printer system according to the present invention is characterized in having, trigger signal generation means, such as the abovementioned reference position detection section, for generating trigger signals for initialting at least one of the printing-related operations, including the font selection, printing, column-shifting, carriage return, and paper-feeding operations; and an endless printing belt which is circulated in motion to a certain direction. The endless printing belt is provided with a signal generation element at its certain position, such as the abovementioned pushing-down element or the slidable conductive contact element, for generating the trigger signals in conjunction with the function of the trigger signal generation means.

As the endless printing belt is circulated in motion, the reference position detection section outputs the reference position detection signal when the pushing-down element or slidable contact section passes on the detection section. Thus, using the detection signal as the trigger signal, the printing-related operations including a printing operation, for example, can be initiated.

Because of the structure which is described above, the printing-related operations including such as the printing and carriage return operations can be initiated in synchronization with the circulation motion of the endless printing belt, using a simple structure. Further, as the trigger signals are directly generated based on the circulation of the endless printing belt, a printer system can be provided with a lower noise generated at the control system and a higher level of reliability.

Further, by providing a multiple of signal generation elements of the trigger signal generation means along the circulating direction of the endless printing belt in an equal interval, a loss time from a start of the circulation movement of the endless printing belt to an initiation of a printing-related operation can be minimized.

As described above, a printer system according to the present invention is characterized in providing a rack which is rotatable for making a carriage return, and the rotation force transmission means which is placed between the rack and the paper-feeding roller. And, by the rotation motion of the rack, the paper-feeding roller is rotated.

Because of the structure as described above, the rotation means of the paper feeding roller can be simplified, and thus the miniaturization of the printer system and the cost saving can be realized.

As described above, according to the present invention, a printer system is characterized in providing a projected section at a certain position on an endless printing belt for detecting the reference position; the detection terminal of the position detection switch is placed on the circulating locus of the projected section; as the endless printing belt circulates in motion, the abovementioned projected section makes a contact with the detection terminal for turning on/off the position detection switch, and thus the reference position detection of the endless printing belt is made.

Because of a structure as described above, it is possible to provide a printer system which is able to correctly make the reference position detecting of the endless printing belt using a simple and economical structure.

Further, in an embodiment of the above description, a case is described where the pushing-down element which corresponds to the projected section for the reference position detecting is a separate element of the endless printing belt, but the abovementioned projected section may be formed as an intergrated portion of the endless printing belt.

Further, in an embodiment of the above description, the pushing-down element (the projection for the reference position detection) is projected downward of the printing belt (the endless printing belt which carries a number of fonts), but a placing of the element is not limited to the one of the embodiment, and it may be projected to the outside, inside, or upward of the endless printing belt. Particularly, when the projection for the reference position detecting is provided to project downward or upward from the endless printing belt and the portion of the projected section for the reference position detecting is held by the flange of the rotating pully, the position detection switch can be surely operated in its on/off operation.

As described above, a printer system according to the present invention is characterized in providing a movable contact section made of electrically conductive material at a predetermined position of the endless printing belt which is circulated in motion to a certain direction, and fixed detection elements, with a certain gap between them, of the position detection switch which are located on the circulation locus of the movable contact section. As the movable contact section makes contact with the fixed detection elements to electrically connect the two elements as the endless printing belt is circulated in motion, and thus the reference position detection of the endless printing belt can be made.

Because of the structure as described above, it is possible to provide a printer system which is able to accurately make the reference position detection of the endless printing belt, using a simple and economical structure.

As described above, a printer system according to the present invention is characterized in providing the endless printing belt on which a number of fonts are arranged on the outer surface of it which is mounted around the driving gear and the driven gear in a manner that the endless printing belt is circulated to only a certain direction, and a printing paper which is positioned at the opposite side of the endless printing belt facing the side of the fonts that are being moved from the driven gear to the direction of the driving gear.

Because of a structure as described above, the side of the endless printing belt facing the printing paper has no sag, and thus the font section will not unnecessarily touch the surface of the printing paper, though the gap between the fonts and the printing paper became narrower as the printer system is made smaller. Therefore, poor quality printing due to sag of the endless printing belt can be eliminated, and higher quality of printing can be assured.

As described above, a printer system according to the present invention is characterized in providing the endless printing belt on which a number of printing fonts are arranged on the outer surface of it for making printing by pushing a selected font onto the printing paper, and the mask element which is positioned between the endless printing belt and the printing paper for defining a certain column of lower-order printing position for printing of symbol and defining the remaining higher order columns for printings of numerals. The mask element is to form a no-printing zone between the lower order printing column and the higher order printing columns with a single-column distance for the no-printing zone.

Because of the structure as described above, the printing zone for symbol and the printing zone for numerals can be clearly distinguished by the no-printing zone between the two, and thus a printed format which is easier to see can be prepared.

In an embodiment of the above description, a single-column width is given to the printing column for symbol and the no-printing zone, respectively. But the implementation is not limited to the one for the above embodiment, and depending on requirement, a distance corresponding to two-column width or more can be given to them.

As described above, a printer system according to the present invention has a printing paper at the opposite side of the fonts arranged on the endless printing belt which carries a number of fonts on the outer surface of the belt, and a carriage which is laterally moved to the crossing direction to the surface direction of the printing paper. The carriage is positioned at the inside of the circulating endless printing belt, facing the rear ends of the fonts. Further, the carriage is mounted on it with a hammer mechanism for striking a selected font at its rear end for pushing the selected font foreward onto the printing paper. A printer system according to the present invention is characterized in having a paper guide section of which at least a part of it for guiding the printing paper which is positioned in between the paper guide section and the hammer is serving the role of a platen, with the printing paper placed in between the paper guide section and the hammer.

Thus, because of the structure as described above, it is possible to provide a printer system which is smaller in size, lighter in weight, and economical in cost.

As described above, further, a printer system according to the present invention is provided with a printing paper at the opposite side of the fonts arranged on the endless printing belt which carries a number of fonts on the outer surface of it, and a carriage which is moved laterally to the crossing direction to the surface of the printing paper. The carriage is positioned at the inside of the circulating endless printing belt facing the rear ends of the fonts. The carriage is mounted on it with a hammer for pushing foreward a selected font onto the printing paper when the font is struck at its rear end. A printer system according to the present invention is characterized in that the arranged fonts are grouped into a first group of fonts which have lower frequency of usage in printing, and a second group of fonts which have higher frequency of usage in printing.

Because of such a structure as described above, in a printing by a font which has a higher frequency of usage, a time required for the font selection can be significantly reduced, and the printing speed can be made higher as faster as possible.

What is claimed is:

1. A printing device including an endless printing belt having a plurality of printing fonts arranged along its outer surface, means for moving said belt along an endless path of movement, means for feeding a recording paper past said endless path of movement, a hammer located within said path of movement, means for moving said hammer towards said belt to push a selected font on said belt towards said recording paper for printing thereon, and means including a clutch for selectively transmitting motive power from a single driving source to either said means moving said belt along said endless path of movement or said means moving said hammer.

2. A printing device according to claim 1, said driving source being a unidirectional d.c. motor.

3. A printing device according to claim 1, the fonts of said printing belt being arranged into a plurality of groups including a first group containing fonts corresponding to respective symbols printed less frequently and two groups arranged in series and including identical fonts corresponding to respective symbols printed more frequently.

4. A printing device according to claim 3, said first group including fonts corresponding to respective mathematical symbols and said two groups each including a font for each respective numerical symbol.

5. A printing device according to claim 1, including a carriage positioned within said path of movement and carrying said hammer, said carriage having means including a wall section adapted to lie between said endless belt and said recording paper and having an opening therein of a size corresponding to a font carried by said endless belt for preventing of said endless belt other than the selected font from contacting the recording paper during actuation of said hammer.

6. A printing device according to claim 1, including a carriage positioned within said path of movement and carrying said hammer, said means for moving said hammer including a rotary shaft extending slidably through said carriage and carrying a cam slidable along said shaft with said carriage and having a portion adapted to move said hammer towards said belt during the initial period of rotation of said shaft; a rack extending along a line to be printed on said recording paper, and a rack cam carried by said rotary shaft for slidable movement along said shaft with said carriage, said rack cam adapted to engage the teeth of said rack and having an idle portion adapted to hold said carriage in position during the initial period of rotation of said shaft and a spiral portion adapted to slide said carriage to the next printing position along said line during the latter period of rotation of said shaft; and means responsive to said clutch for rotating said shaft through no more than one revolution each time said clutch activates rotation of said shaft.

7. A printing device according to claim 6, said means for rotating said shaft including a printing gear adapted to engage a main gear rotated continuously, said printing gear having a first gear position adapted to mesh with said main gear but extending only partially around the circumference thereof and means for bringing said gear portion into engagement with said main gear when printing is desired, said bringing means includes a lever holding said printing gear in rotational position where said gear portion does not engage said main gear, resilient means for urging said printing gear to rotate to bring said gear portion into engagement with said main gear and means including a solenoid for withdrawing said lever to enable said resilient means to bring said gear portion into engagement with said main gear.

8. A printing device according to claim 6, including means resiliently urging said carriage to its home position, and return means for pivoting said rack out of engagement with said rack cam upon completion of the printing of a line to return said carriage to its position, said return means including a release lever carried by said carriage and slidable along said rack while in engagement therewith, said release lever having a dog portion extending upwardly between said carriage and said belt, and depressing means carried by said belt and actuated by said hammer for engaging said dog portion to pivot said release lever to move said rack out of engagement with said rack cam.

9. A printing device according to claim 8, said dog portion extending to a height below the fonts carried by said belt so as not to be engaged thereby during printing, said depressing means extending to a level below that of said fonts so as to be able to actuate said dog portion.

10. A printing device according to claim 9, including contact means positioned in said path of movement and responsive to said depressing means for signaling a reference position of said belt.

11. A printing device according to claim 8, including contact means positioned along said path of movement and responsive to said depressing means for signaling a reference position of said belt.

12. A printing device according to claim 6, including rack-return means for pivoting said rack back into engagement with said rack cam before beginning the next line of printing, said rack-return means including a return cam carried by said shaft and slidable therealong with said carriage and a lever connected to said rack near the home position of said carriage for engaging said return cam to return said rack upon rotation of said shaft.

13. A printing device according to claim 12, including means actuated by the return of said rack for feeding said recording paper.

14. A printing device including an endless printing belt having a plurality of printing fonts arranged along its outer surface, means for moving said belt along an endless path of movement, means for feeding a recording paper past said endless path of movement, a hammer located within said path of movement, means for moving said hammer towards said belt to push a selected font on said belt towards said recording paper for printing thereon, said printing belt being arranged into a plurality of groups including a first group containing fonts corresponding to respective symbols printed less frequently and two groups arranged in series and including identical fonts corresponding to respective symbols printed more frequently.

15. A printing device according to claim 14, said first group including fonts corresponding to respective mathematical symbols and said two groups each including a font for each respective numerical symbol.

16. A printing device including an endless printing belt having a plurality of printing fonts arranged along its outer surface, means for moving said belt along an endless path of movement, means for feeding a recording paper past said endless path of movement, a hammer located within said path of movement, means for moving said hammer towards said belt to push a selected font on said belt towards said recording paper for printing thereon, a carriage positioned within said path of movement and carrying said hammer, said carriage having means including a wall section adapted to lie between said endless belt and said recording paper and having an opening therein of a size corresponding to a font carried by said endless belt for preventing portions of said endless belt other than the selected font from contacting the recording paper during actuation of said hammer.

17. A printing device including an endless printing belt having a plurality of printing fonts arranged along its outer surface, means for moving said belt along an endless path of movement, means for feeding a recording paper past said endless path of movement, a hammer located within said path of movement, means for moving said hammer towards said belt to push a selected font on said belt towards said recording paper for printing thereon, means including a rack adapted to engage a cam rotated after actuation of said hammer to move said hammer and said cam along the line to be printed, means for urging said hammer and said cam back towards an initial position along a line to be printed, return means for pivoting said rack out of engagement with said cam and then back into engagement therewith upon said return, and means actuated by said return means for feeding the paper.

* * * * *